US006763992B2

(12) United States Patent
Hirai

(10) Patent No.: US 6,763,992 B2
(45) Date of Patent: Jul. 20, 2004

(54) DRIVING DEPTH ADJUSTING MECHANISM FOR A NAILER

(75) Inventor: Shoichi Hirai, Hitachinaka (JP)

(73) Assignee: Hitachi Koki Co., Ltd. (JP)

( * ) Notice: Subject to any disclaimer, the term of this patent is extended or adjusted under 35 U.S.C. 154(b) by 0 days.

(21) Appl. No.: 10/273,167

(22) Filed: Oct. 18, 2002

(65) Prior Publication Data

US 2003/0080172 A1 May 1, 2003

(30) Foreign Application Priority Data

Oct. 26, 2001 (JP) ..... 2001-329314

(51) Int. Cl.[7] ..... B25C 7/00
(52) U.S. Cl. ..... 227/142; 227/130
(58) Field of Search ..... 227/8, 130, 142

(56) References Cited

U.S. PATENT DOCUMENTS 5,219,110 A * 6/1993 Mukoyama ..... 227/8
5,261,587 A * 11/1993 Robinson ..... 227/8
5,385,286 A * 1/1995 Johnson, Jr. ..... 227/8
5,579,977 A * 12/1996 Yang ..... 227/142
5,685,473 A * 11/1997 Shkolnikov et al. ..... 227/8
5,785,227 A * 7/1998 Akiba ..... 227/8
6,024,267 A * 2/2000 Chen ..... 227/8
6,170,729 B1 * 1/2001 Lin ..... 227/8
6,176,412 B1 * 1/2001 Weinger et al. ..... 227/142

* cited by examiner

*Primary Examiner*—Scott A. Smith
*Assistant Examiner*—Chukwurah Nathaniel
(74) *Attorney, Agent, or Firm*—Parkhurst & Wendel, L.L.P.

(57) ABSTRACT

A bolt 6, accommodated in a cylinder knob 10, is screwed into a main body 5 to restrict the shift movement of a push lever 1. A spline coupling, provided between a hexagonal bore 10*a* formed in the cylinder knob 10 and a hexagonal head 6*a* of the bolt 6, transmits a rotational motion of cylinder knob 10 to the bolt 6 and allows the cylinder knob 10 to slide with respect to the main body 5. A projection 12 of the main body 5 and a notch 10*b* of the cylinder knob 10, when engaged with each other under a resilient force of a spring 12, cooperatively constitute a stopper for restricting the rotation of the cylinder knob 10 with respect to the main body 5.

5 Claims, 6 Drawing Sheets

DRIVING DEPTH ADJUSTING MECHANISM FOR A NAILER

BACKGROUND OF THE INVENTION

The present invention relates to a driving depth adjusting mechanism for a nailer or a comparable fastening tool which is capable of adjusting the driving depth of a nail or a comparable fastening member without using a dedicated or special adjusting tool such as a spanner.

A method for adjusting the driving depth of a nailer or a comparable fastening tool is conventionally known. In this case, the driving depth is expressed by a height from the head of a nail (or a fastening member) struck into a board or a comparable base material by a nailer (or a comparable fastening tool) to the surface of the board material. For example, the protruding length adjustment for a driver blade of a nailer or a comparable fastening tool is feasible by adjusting a distance between the distal end of a push lever and the distal end of the driver blade under the condition that the push lever is placed on the surface of the board material into which the nail or the fastening member is struck or driven while the driver blade is positioned at its bottom dead center.

FIG. 11 shows a nail striking operation of a nailer equipped with a conventional driving depth adjusting mechanism. To implement the nail striking operation, a push lever 1 is first placed on the surface of a board material 3 into which a nail 16 is driven. A spring 2 resiliently urges the push lever 1 downward. When raised by a user, the push lever 1 can shift upward against a depression or resilient force of the spring 2. A shaft 4 shifts upward together with the push lever 1. A bolt 6, screwed into a main body 5 at a predetermined upper portion above the shaft 4, restricts the reachable uppermost position of the shaft 4 shifting in the up-and-down direction. In other words, a protruding length S of a driver blade 7, in the condition that the driver blade 7 is positioned at a bottom dead center, is restricted by the position of bolt 6. The protruding length S determines the driving depth of the nailer.

FIG. 12 explains the details of the driving depth adjustment performed by a user. A nut 8 is engaged with the bolt 6. The nut 8 and a female thread of the main body 5 cooperatively constitute a double nut engagement for securely fixing the bolt 6 with respect to the main body 5. First, the user loosens the nut 8 by using a spanner or the like. With this loosening operation, the fixation of the bolt 6 to the main body 5 is released. Next, the user rotates the bolt 6 in either direction to change the distance between a bolt head 6*a* and the main body 5. Then, the user fastens the nut 8 by using the spanner or the like to again establish the double nut engagement for securely fixing the bolt 6. When the user performs a nail striking operation after the position of the bolt head 6*a* is changed, the reachable uppermost position of the push lever 1 changes. The protruding length S of the driver blade 7 also changes. Accordingly, the driving depth of the nailer changes.

According to the above-described conventional driving depth adjusting mechanism of a nailer, the female thread of the main body 5 and the nut 8 cooperatively constitute the double nut engagement for securely fixing the bolt 6. This arrangement forces the user to frequently use the spanner or any other comparable adjusting tool for loosening or fastening the bolt 6. It takes a significantly long time for each adjustment of the driving depth of a nailer. It is needless to say that the user must always keep the spanner or the like.

SUMMARY OF THE INVENTION

An object of the present invention is to provide a driving depth adjusting mechanism for a nailer which assures improved operability in the driving depth adjustment and allows a user to implement the driving depth adjustment without using a spanner or any other comparable adjusting tool for loosening or fastening the bolt.

In order to accomplish this and other related objects, the present invention provides a driving depth adjusting mechanism for a nailer or a fastening tool having a main body and a push lever. The main body is equipped with a driver blade for driving a nail or a fastening element and an ejecting section from which the nail of the fastening element is pushed out. The push lever, extending along the ejecting section, reciprocates in an axial direction of the driver blade for controlling the driving operation. The driving depth adjusting mechanism includes a bolt screwed into a hole of the main body for regulating an uppermost position of the push lever during a striking operation of the nail or the fastening element, a knob having an inner space for accommodating the bolt, and a spline coupling provided between the bolt and the knob for transmitting a rotational motion of the knob to the bolt and for allowing the knob to slide in the axial direction.

Preferably, the driving depth adjusting mechanism further comprises a stopper for restricting a mutual rotation between the knob and the main body, and an elastic member for elastically urging the knob in a direction for restricting the mutual rotation between the knob and the main body.

Preferably, the spline coupling is constituted by a hexagonal inner wall of the knob and a hexagonal head of the bolt.

Preferably, the knob is a resin-made member.

Preferably, the knob has a projection in the inner space for preventing the bolt from being pulled out.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
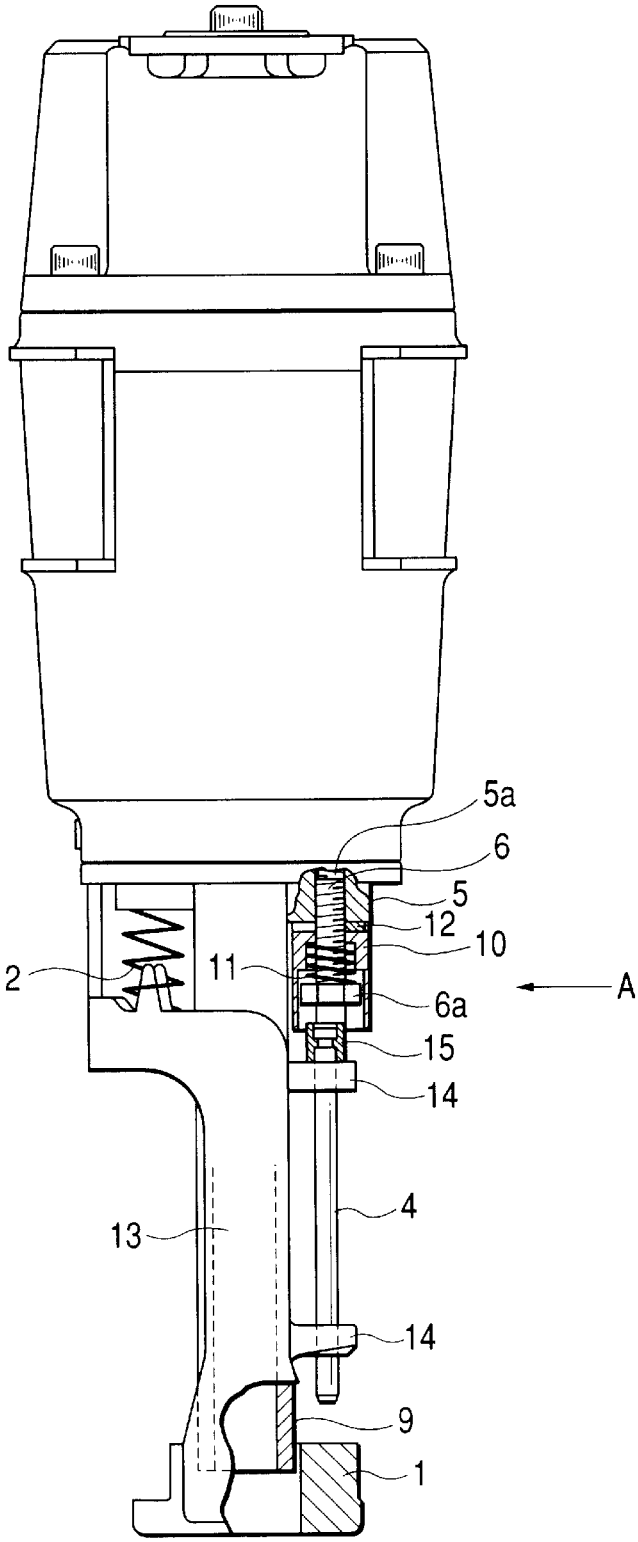
FIG. 1 is a partly cross-sectional view showing a driving depth adjusting mechanism for a nailer in accordance with a preferred embodiment of the present invention.

Preferred embodiments of the present invention will be explained with reference to attached drawings. Identical parts are denoted by the same reference numerals.

FIGS. 1 to 5 show a driving depth adjusting mechanism for a nailer in accordance with a preferred embodiment of the present invention.

A vertically extending bolt 6, accommodated in a cylinder knob 10, is screwed into a hole 5*a* of a main body 5. The bolt 6 has a head 6*a* formed at a lower part thereof. The bolt head 6*a* has a hexagonal configuration. The cylinder knob 10 has an inner space configured into a hexagonal bore 10*a*. The hexagonal head 6*a* of the bolt 6 engages with the hexagonal bore 10*a* of the cylinder knob 10 so as to constitute a sort of spline coupling for transmitting the rotational motion of the cylinder knob 10 to the bolt 6.

Figure 2:
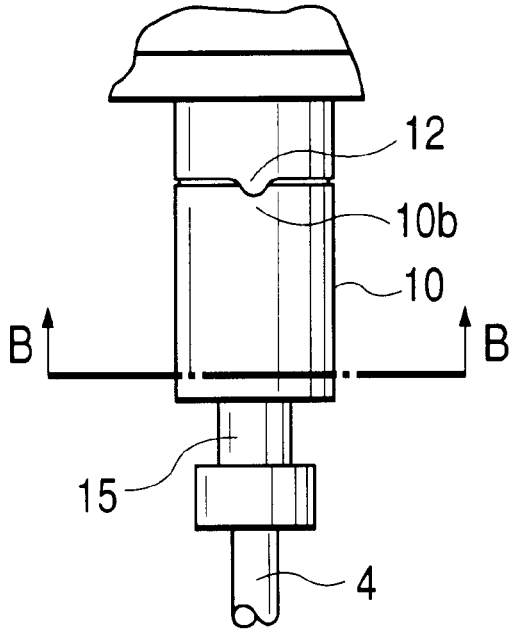
FIG. 2 is an enlarged side view showing an essential part of the driving depth adjusting mechanism for a nailer in accordance with the preferred embodiment of the present invention, seen from the direction of arrow A shown in FIG. 1.
Figure 3:
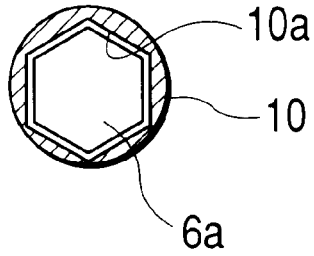
FIG. 3 is a transverse cross-sectional view showing the essential part of the driving depth adjusting mechanism for a nailer in accordance with the preferred embodiment of the present invention, taken along a line B—B shown in FIG. 2.

The bolt 6, when rotating, shifts in its axial direction (i.e., in the vertical direction in FIG. 1). The bolt head 6*a*thus slides along the surfaces of the hexagonal bore 10*a*. A spring 11, disposed coaxially around the bolt 6, serves as an elastic member for elastically urging the cylinder knob 10 toward the main body 5. The lower end of the spring 11 roots on the flange of the bolt head 6*a*. The upper end of the spring 11 supports an inner end surface of the cylinder knob 10. The main body 5 has a knob seat with a projection 12. The knob seat is a surface perpendicular to the bolt 6. On the other hand, as shown in FIG. 2, a notch 10*b* engaging with the projection 12 of the, knob seat (i.e., main body 5). Although only one notch 10*b* is shown in FIG. 2, a plurality of notches 10*b* are provided on an upper end surface of the cylinder knob 10 (refer to FIG. 5). The upper end surface of the cylinder knob 10, perpendicular to the bolt 6, fits with the knob seat of the main body 5. The projection 12 and the notch 10*b*, when engaged with each other, cooperatively constitute a stopper for restricting the rotation of the cylinder knob 10 with respect to the main body 5. A shaft 4, vertically extending in parallel with the axis of the nailer (i.e., the axis of a driver blade 7), is provided below the bolt head 6*a*. The shaft 7 transmits the shifting movement of a push lever 1 to the bolt 6. A boss 14, integrally formed on an outer surface of an ejecting section 13, supports the shaft 4 sliding in the vertical direction. A spacer 15, attached to an upper end of the shaft 4, restricts or regulates the lowermost position of the bolt 6 so as to prevent the bolt 6 from being pulled out of the hole 5*a* of main body 5. The push lever 1, disposed below the shaft 4, is slidable along the ejecting section 13 so as to reciprocate in the vertical direction (i.e., in the axial direction of the driver blade 7). The push lever 1 has a function of controlling a nail striking operation together with a trigger (not shown). The push lever 1 extends from the trigger to the ejecting section 13.

Figure 4:
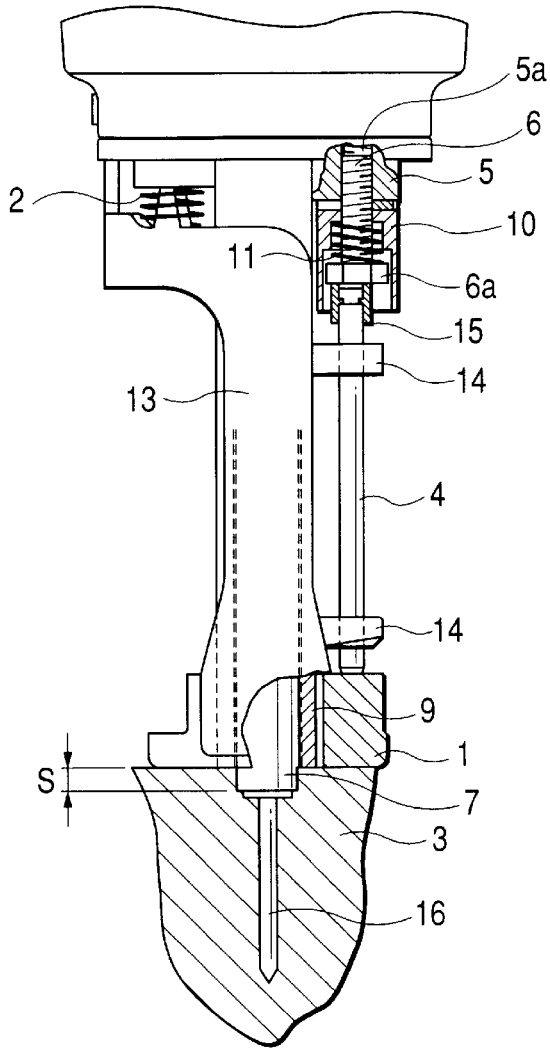
FIG. 4 is a partly cross-sectional view showing a nail striking operation performed by the nailer in accordance with the preferred embodiment of the present invention.

FIG. 4 explains the operation of the driving depth adjusting mechanism of this embodiment.

To implement the nailing operation, the distal end of the push lever 1 first is placed on a board material 3 into which a nail 16 is driven. The spring 2 always urges the push lever 1 downward, i.e., toward the board material 3. In this condition, a user adds from above a pressing force to the push lever 1 to forcibly raise the push lever 1 upward relative to the main body 5 against the resilient force of the spring 2. The push lever 1 first hits the lower end of shaft 4. Then, the shaft 4 and the push lever 1 shift together in the upward direction until the upper end of shaft 4 is stopped by the bolt head 6*a*. Then, the user activates the nailer. In response to the user's manipulation, the driver blade 7 strikes the nail 16 to push it out of the ejecting section 9. The driving depth of the nailer, i.e., the driven depth of the nail 16, is expressed by a distance from the bottom dead center of the driver blade 7 to the distal end of the push lever 1, i.e., the protruding length S of the driver blade 7.

Figure 5:
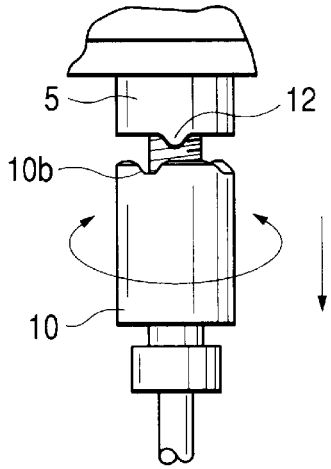
FIG. 5 is a side view explaining an operation of the driving depth adjusting mechanism for a nailer in accordance with the preferred embodiment of the present invention.

When the user wants to change the driving depth of the nailer, the user pulls the cylinder knob 10 downward against the resilient force of the spring 11 as shown by a straight arrow in FIG. 5 to release the engagement between the projection 12 and the notch 10*b*. Then, the user turns the cylinder knob 10 about its axis in a predetermined direction while the user continuously adds a pulling force to the cylinder knob 10 downward to maintain the disengaged condition between the projection 12 and the notch 10*b*. The rotational motion of cylinder knob 10 is transmitted to the bolt 6 via the spline coupling provided between the hexagonal bore 10*a* of the cylinder knob 10 and the hexagonal bolt head 6*a*.

For example, when the user increases the driving depth of the nailer, the user turns the cylinder knob 10 by a predetermined amount in a predesignated direction to deepen the bolt 6 in the hole 5*a* of the main body 5. In this case, one complete rotation of the cylinder knob 10 causes the same complete rotation of the bolt 6 (corresponding to a 360° angular displacement). This causes a shifting of the bolt 6 in the axial direction by an amount corresponding to a lead of the bolt 6. Accordingly, the stroke of the shaft 4 shifting in the vertical direction increases by the amount of the lead of the bolt 6. The protruding length S of the driver blade 7 increases by the amount of the lead of the bolt 6, too. Accordingly, the nail 16 is struck deeply into the board material 3 in accordance with the increased driving depth of the nailer.

On the other hand, when the user decreases the driving depth of the nailer, the user turns the cylinder knob 10 by a predetermined amount in the opposite direction to shallow the bolt 6 in the hole 5*a* of the main body 5. One complete rotation of the cylinder knob 10 causes the same complete rotation of the bolt 6 (corresponding to a 360° angular displacement), accompanied by a shifting of the bolt 6 in the axial direction by an amount corresponding to the lead of this bolt 6. The stroke of the shaft 4 shifting in the vertical direction decreases by the amount of the lead of the bolt 6. The protruding length S of the driver blade 7 decreases by the amount of the lead of the bolt 6, too. Accordingly, the nail 16 is struck shallowly into the board material 3 in accordance with the decreased driving depth of the nailer.

When a total of n notches 10*b* are provided on the upper end surface of the cylinder knob 10 at angularly equivalent intervals, it is possible to precisely adjust the driving depth of the nailer in a stepwise manner with a minimum advancement defined by (the lead amount of bolt 6)/n.

In this manner, according to the driving depth adjusting mechanism for a nailer according to the above-described embodiment, it becomes possible to easily adjust the protruding length S of the driver blade 7 without using a spanner or any other comparable adjusting tool for loosening or fastening the bolt 6. The driving depth adjusting mechanism for a nailer according to the above-described embodiment allows a user to manipulate the cylinder knob 10 which selectively engages with the bolt 6 to adjust the stroke of the shaft 4 which regulates the shifting movement of push lever 1. The cylinder knob 10 is a component always associated with the main body 5 and requiring no special adjusting tool such as a spanner. In other words, the above-described embodiment assures excellent operability in the driving depth adjustment for a nailer.

Allowing a user to manipulate the cylinder knob 10 to rotate the bolt 6 makes it easy to finely and promptly adjust the rotational position of the bolt 6.

It is preferable that the cylinder knob 10 is a resin-made member. This makes it possible to improve the operation feeling of the cylinder knob 10 and reduce the cost of the cylinder knob 10. The cylinder knob 10 having a light weight is advantageous in that the cylinder knob 10 does not bound so much in response to a reaction force of the nail striking operation. This makes it possible to reduce a resilient force required for the spring 11. The user can easily manipulate the cylinder knob 10 with a relatively small pulling force when the user disengages the cylinder knob 10 from the main body 5.

Figure 6:
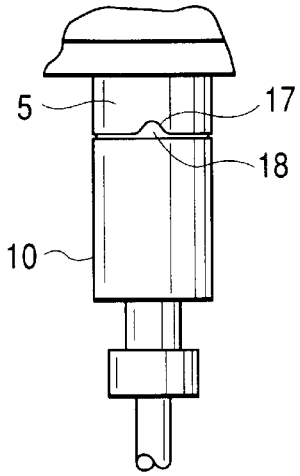
FIG. 6 is an enlarged side view showing an essential part of the driving depth adjusting mechanism for a nailer in accordance with another preferred embodiment of the present invention.

FIG. 6 is a view showing another embodiment of the driving depth adjusting mechanism for a nailer in accordance with the present invention. According to this embodiment, a plurality of notches 17 are formed on the knob seat of the main body 5. A projection 18 is provided on an upper end surface of the cylinder knob 10. The notch 17 and the projection 18, when engaged with each other, cooperatively constitute a stopper for restricting the rotation of the cylinder knob 10 with respect to the main body 5. This embodiment brings the same functions and effects as those of the embodiment shown in FIGS. 1 to 5.

Figure 7:
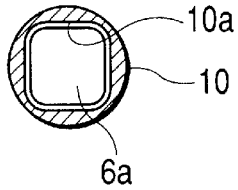
FIG. 7 is a cross-sectional view showing another example of a spline coupling for the driving depth adjusting mechanism for a nailer in accordance with the preferred embodiment of the present invention.
Figure 8:
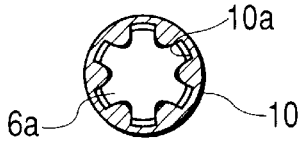
FIG. 8 is a cross-sectional view showing another example of the spline coupling for the driving depth adjusting mechanism for a nailer in accordance with the preferred embodiment of the present invention.
Figure 9:
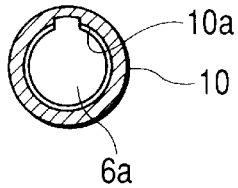
FIG. 9 is a cross-sectional view showing another example of the spline coupling for the driving depth adjusting mechanism for a nailer in accordance with the preferred embodiment of the present invention.

FIGS. 7 through 9 show other embodiments of the driving depth adjusting mechanism in accordance with the present invention. In each embodiment shown in FIGS. 7 through 9, the bore 10*a* and the bolt head 6*a* are structurally modified. In other words, the configurations of the bore 10*a* and the bolt head 6*a* can be changed in various ways as far as they cooperatively constitute the spline coupling.

Figure 10:
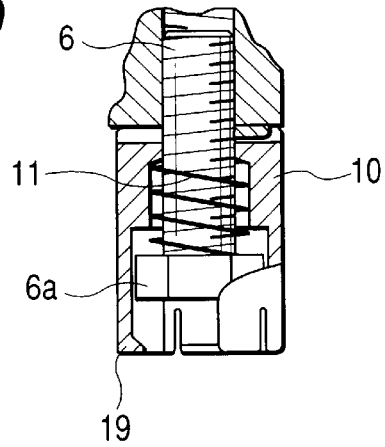
FIG. 10 is a cross-sectional view showing another example of the driving depth adjusting mechanism for a nailer in accordance with the preferred embodiment of the present invention.
Figure 11:
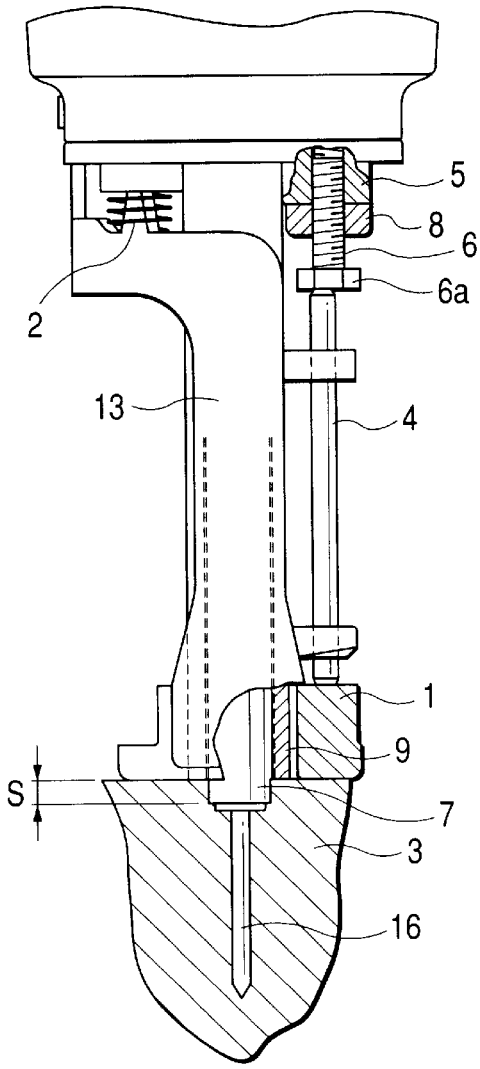
FIG. 11 PRIOR ART
FIG. 11 is a partly cross-sectional view showing a nail striking operation of a nailer equipped with a conventional driving depth adjusting mechanism.
Figure 12:
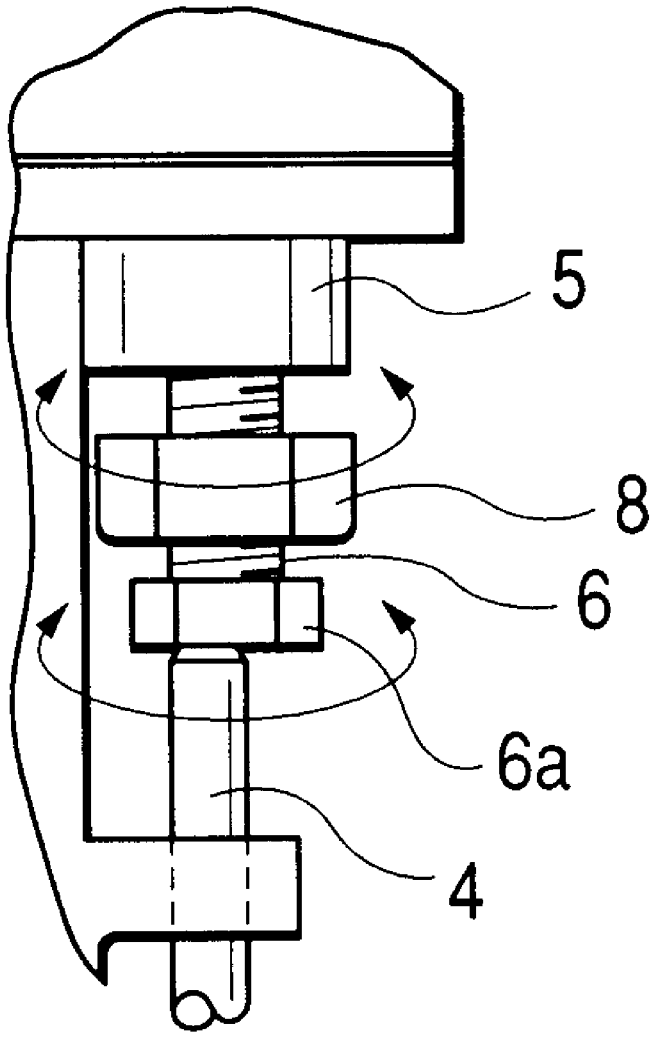
FIG. 12 PRIOR ART
FIG. 12 is a side view explaining a driving depth adjustment performed in accordance with the conventional driving depth adjusting mechanism.

FIG. 10 shows another embodiment of the driving depth adjusting mechanism in accordance with the present invention. According to this embodiment, a snap fit 19 is integrally formed at the lower end of the cylinder knob 10. The snap fit 19 is an elastically deformable portion capable of holding the bolt head 6*a* so as to prevent the bolt 6 from being pulled out of the hole 5*a* of main body 5. In this respect, the snap fit 19 restricts or regulates the lowermost position of the bolt 6. Thus, the spacer 15 shown in FIG. 1 can be omitted. The bolt 6, the cylinder knob 10, and the spring 11 are handled as a preassembled unit. Thus, it becomes possible to improve the assembling work for the driving depth adjusting mechanism of a nailer or a comparable fastening tool.

As apparent from the foregoing description, the present invention provides a driving depth adjusting mechanism for a nailer or a comparable fastening tool which includes the cylinder knob 10 allowing a user to rotate and fix the bolt 6 used for adjusting the stroke of the push lever 1 without using a spanner or the like, thereby realizing easy and quick adjustment of the driving depth of the nailer or the comparable fastening tool.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A driving depth adjusting mechanism for a fastening tool comprising:

a main body, a push lever, a driver blade slidably retained in said main body for driving a fastening element in an axial direction and an ejecting section from which a fastening element is pushed out, said push lever extending along said ejecting section for reciprocation in a direction parallel to the axial direction of said driver blade for controlling the driving operation, said driving depth adjusting mechanism comprising:

a bolt screwed into a hole in said main body for regulating an uppermost position of said push lever during a striking operation of a fastening element;

a knob having an inner space for accommodating said bolt; and a spline coupling located between said bolt and said knob for restricting relative rotation between said bolt and said knob while still permitting relative sliding movement in a direction parallel to the axial direction between said bolt and said knob, for transmitting a rotational motion of said knob to said bolt and for allowing said knob to slide in the axial direction.

2. The driving depth adjusting mechanism for a fastening tool according to claim 1, further comprising a stopper for restricting a mutual rotation between said knob and said main body, and an elastic member for elastically urging said knob in a direction for restricting the mutual rotation between said knob and said main body.

3. The driving depth adjusting mechanism for a fastening tool according to claim 1, wherein said spline coupling is constituted by a hexagonal inner wall of said knob and a hexagonal head of said bolt.

4. The driving depth adjusting mechanism for a fastening tool according to claim 1, wherein said knob is a resin-made member.

5. The driving depth adjusting mechanism for a fastening tool according to claim 1, wherein said knob has a projection in said inner space for preventing said bolt from being pulled out.

* * * * *